United States Patent [19]

Fickelscher et al.

[11] Patent Number: 4,580,957

[45] Date of Patent: Apr. 8, 1986

[54] ROTARY FLUID-FLOW MACHINE WITH THIN-WALLED ANNULAR PISTON

[75] Inventors: Kurt G. Fickelscher, Herderstrasse 19, D-6710 Frankenthal, Fed. Rep. of Germany; Hans-Peter Schabert, Erlangen, Fed. Rep. of Germany

[73] Assignee: Kurt G. Fickelscher, Frankenthal, Fed. Rep. of Germany

[21] Appl. No.: 678,590

[22] Filed: Dec. 5, 1984

[30] Foreign Application Priority Data

Dec. 5, 1983 [DE] Fed. Rep. of Germany ..... 3343908

[51] Int. Cl.[4] ..... F01C 1/00; F01C 5/02; F01C 17/00

[52] U.S. Cl. ..... 418/57; 418/63; 418/65; 418/156

[58] Field of Search ..... 418/45, 56, 57, 63, 418/65, 153, 156

[56] References Cited

U.S. PATENT DOCUMENTS

| | | | |
|---|---|---|---|
| 1,692,639 | 11/1928 | Elsner . | |
| 2,050,473 | 8/1936 | Steinmann | 418/153 |
| 2,922,378 | 1/1960 | Pabst | 418/63 |
| 2,992,769 | 7/1961 | Manzanera . | |
| 3,216,362 | 11/1965 | Hewko . | |
| 4,390,328 | 6/1983 | Fickelscher | 418/45 |

FOREIGN PATENT DOCUMENTS

| | | | |
|---|---|---|---|
| 664630 | 9/1938 | Fed. Rep. of Germany . | |
| 669091 | 12/1938 | Fed. Rep. of Germany . | |
| 1956755 | 5/1971 | Fed. Rep. of Germany . | |
| 2525744 | 12/1976 | Fed. Rep. of Germany | 418/45 |
| 2541835 | 3/1977 | Fed. Rep. of Germany . | |
| 2911655 | 10/1980 | Fed. Rep. of Germany . | |
| 981898 | 5/1951 | France . | |
| 981992 | 6/1951 | France . | |
| 32495 | 10/1964 | German Democratic Rep. . | |

*Primary Examiner*—John J. Vrablik

*Attorney, Agent, or Firm*—Schwartz, Jeffery, Schwaab, Mack, Blumenthal & Evans

[57] ABSTRACT

A machine, in particular a working machine for the compression and conveyance of fluids, comprises a cylinder (2) and a thin-walled annular piston (4) arranged eccentrically with respect to the cylinder (2), with the piston being in flat contact either inside or outside with a cylinder wall (8). The cylinder (2) or the cylinder housing, contains a parting element (12) whereby a suction chamber (33) is separated from a pressure chamber (35) between the cylinder and the annular piston (4) and whereby by means of a rotating body a rotating motion may be imparted to the annular piston (4). The annular piston (4) is to be exposed to low alternating stresses and between the cylinder (2) and the annular piston (4) a low local surface pressure is to be achieved, while assuring a reliable contact in the rolling range (A). It is proposed according to the invention to provide an essentially circular configuration of the annular piston (4), with the deviation from the circular amounting a maximum of 5% of the piston diameter and that further the center (26) of the annular piston (4) with the rotating body be arranged offset in the direction of the rolling range (A) from the center (28) of the cylinder (2) by the sum of the eccentricity (e) and the deformation (d). The eccentricity here is equal to one-half of the difference of the diameters of the cylinder (2) and the annular piston (4), while the magnitude of the rolling range (A) is determined by the deformation (d).

23 Claims, 28 Drawing Figures

ROTARY FLUID-FLOW MACHINE WITH THIN-WALLED ANNULAR PISTON

Figure 1:
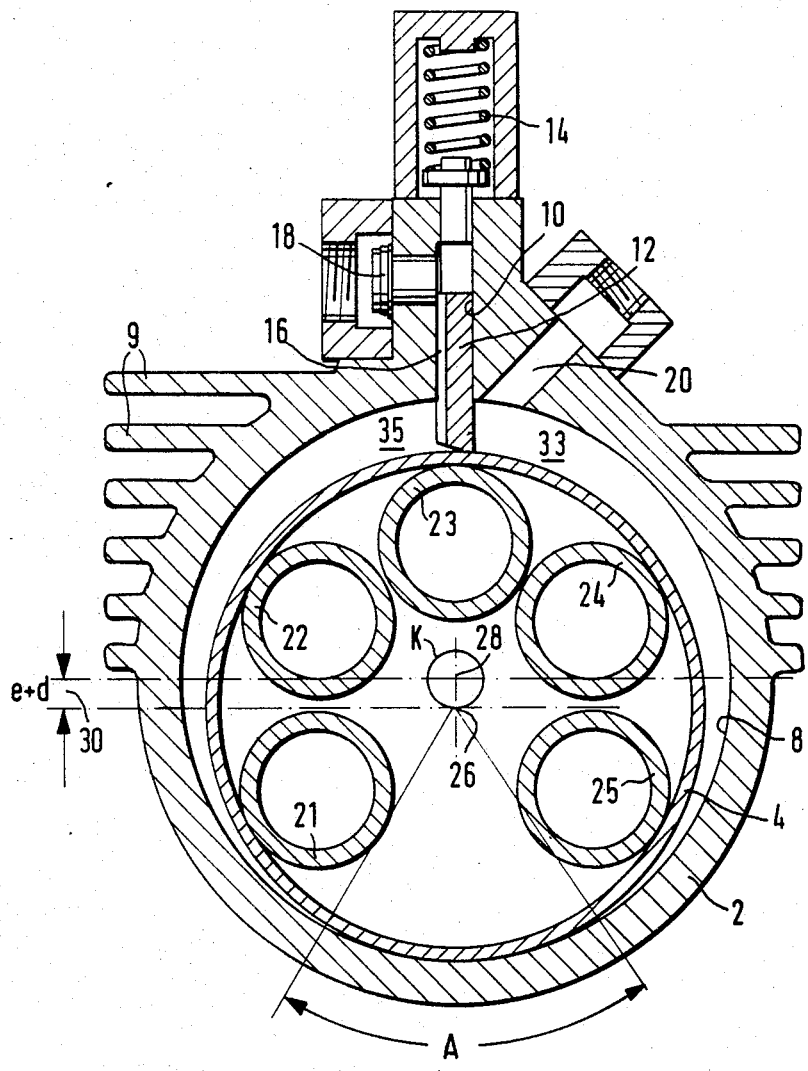

The invention relates to a machine, in particular a work machine for the compression and conveyance of fluids, with a cylinder, with a thin-walled annular piston mounted excentrically in relation to the cylinder and flatly contacting one wall of the cylinder, with a parting element whereby between the cylinder and the annular piston a suction and a compression chamber are separated from each other, and with a rotating body to transmit a rotating motion to the annular piston.

A machine of this type is described in U.S. Pat. No. 4,390,328, the annular piston whereof has the shape of an ellipsis or trochoid. The annular piston is a thin-walled, elastically deformable annulus arranged either within a circular cylinder or around a circular cylinder. The annular piston is mounted on or within a rotating body comprising at least two projections and is being pressured within the area of said projections against the internal or external wall of the cylinder, so that in the course of the rotating motion of the rotating body the annular piston is rolling within a predetermined angular range on the wall of the cylinder. It is obtained thereby that when the parting element is moving over the parting slit the annular piston does not lose its necessary frictional contact with the cylinder and that simultaneously the pressure and suction slits are covered, thereby preventing a backflow between the suction and the pressure slit. The annular piston, which may also be designated as a deformed sleeve or rolling membrane, is exposed to high requirements with respect to its mechanical strength. In the case of an elliptical annular piston and to an even greater extent with an annular piston in the shape of a trochoid, there are high alternating stresses so that with economical suction volumes extensive deformations, i.e. deviations from the annulus, occur, which in actual practice may be effected with very thin-walled sleeves only. This limits the pressure applied by the conveying medium to lower values. There are further difficulties caused by the restoring forces applied by the deformable annular piston to the drive bearings. The relatively large ovalization of the annular piston causes high alternating stresses, thereby affecting the service life of the annular piston. Furthermore, upon its rolling over the parting slit a relatively high frequency spring motion of the annular piston is observed and as the result of the impact of the annular piston on the cylinder a rapid fatiguing of the material in the vicinity of the parting slit must be expected; it was therefore necessary to use high strength materials for the cylinder. The high restoring forces which act in addition to the compression forces on the bearings, result in large stresses in the bearings. An increase in the wall thickness of the annular piston leads to an appreciable increase in the stress distribution, requiring the use of high strength materials in view of the increased local surface pressure within the rolling zone of the cylinder housing.

Based on a machine of the aforementioned type, it is the object of the present invention in view of the disadvantages described above, to further develop the machine at a moderate cost so that the stress on the different structural parts, in particular the annular piston and the cylinder, are reduced, together with the wear of said parts. The machine is to have a high mechanical and thermal efficiency and be suitable for vacuum and high pressure conveyance. High mechanical stressing of the cylinder is to be avoided and the elastic restoring forces on the drive bearings are to be reduced. Low surface pressures between the annular piston and the cylinder are to be achieved and the use of inexpensive, simple materials made possible. Alternating stressing is to be reduced. Furthermore, the machine should be running quietly and have a long service life and the housing structure should permit simple and reliable cooling, in particular air or water cooling selectively. While retaining the essential design data, the machine is to be suitable for operation without oil, grease lubrication or oil flooding. Finally, the machine should be designed so that a material with lesser mechanical properties and preferably with good thermal conductivity may be employed, with aluminum alloys and in the case of aggressive gases, bronzes and austenite being mentioned in particular.

To attain this object, it is proposed to render the annular piston essentially circular with a maximum deviation from the circular shape of 5% of the diameter of the annular piston, to arrange the center of the annular piston with the rotating body offset in the direction of the rolling range with respect to the center of the cylinder by the sum of the eccentricity and a certain deformation, with said eccentricity being equal to one-half of the difference in diameter of the cylinder and the annular piston. By means of the deformation, a flat contact is assured within the predetermined rolling range, which preferably is greater than 10 angular degrees, with the center of the annular piston being rotated essentially on a circular path around the center of the cylinder.

The machine according to the invention is characterized by a simple design and high operating safety. Compared to the annular pistons in the shape of ellipses, trochoids or the like, the essentially circular piston according to the invention deviates only slightly from the circular, i.e, by a maximum of 5%, so that a slight deformation and low material stress are obtained in a surprisingly simple manner. Due to the increase of the eccentricity by the deformation, the annular piston remains in contact in the rolling zone with the cylinder, respectively with the internal or external wall of the cylinder. It is assured further that while rolling over the parting slit the predetermined frictional momentum is retained and the suction and pressure slits are sealingly closed. The result is a low alternating stress in particular during the roll over said slits. If, for example, a diameter ratio of 1.12 and thus an eccentricity of approximately 6% is given, a deformation of only 0.5% is sufficient to obtain a surface coverage of about 30% of the angle of circumference. The deformation and the respective increase in eccentricity proposed by the invention is sufficient to equalize thermally caused out-of-roundnesses. The machine may be adapted to high and low pressures in particular by the variation of the wall thickness of the annular piston and the aforementioned offset. Extensive ovalization and the high alternating stresses associated with it are avoided, thereby assuring a long service life of the annular piston. Furthermore, the restoring forces applied by the annular piston on the bearings are considerably reduced. A good distribution of forces and consequently low surface pressures are obtained between the annular piston and the cylinder housing in view of the large angular rolling range. According to the invention, the deformation is within a range of 0.2 to 2%, preferably 0.5% of the piston diameter. Good contact of the annular piston with the cylinder wall over a large angular area is assured. By means of the configuration of the invention, ovalization, i.e. the deviation from the exact circular shape of the annular piston, is kept less than 5% and preferably less than 3%, from the external diameter. In view of the reduction of the surface pressure and its equilization in the rolling range, materials with a good thermal conductivity and lesser mechanical properties, in particular aluminum alloys and for aggressive gases, bronzes or austenitic alloys may be used. The high frequency elastic vibration of the annular piston in the area of the parting slit for the parting slide and the associated impacts of the annular piston are substantially reduced, which is of great importance with respect to service life and the selection of materials. Finally, the machine may used without any appreciable alteration of the essential structural components for vacuum and high pressure transportation. With machines constructed according to the invention single stage vacuums to 99% and terminal pressures to 16 bar were obtained, while a material with good thermal conductivity but lesser mechanical properties were used for the cylinder housing. The special housing design permits selectively the application of air or water cooling with the same housing. The machine is suitable while retaining its essential structural characteristics for operation both without oil, grease lubrication or oil flooding. High mechanical and thermal efficiencies are obtained, with a very quiet operation and reduced wear. The annular piston may be arranged, while remaining within the invention, both inside or outside the cylinder.

In a particular form of embodiment, on the rotating body a plurality of rotatable drive rolls are mounted offset in the circumferential direction with respect to each other, in a manner such that the drive rolls closest to the rolling range have a significantly larger angular distance between them as the remaining angular distances between the drive rolls. A structurally simple bearing support of the annular piston on several, in particular five, drive rolls with simultaneous good contact over a large rolling range is provided. By adjusting the magnitude of the angular distance, the wall thickness of the annular piston and the deformation, the machine is adapted to high or low pressures. In order to prevent the loss of contact by individual drive rolls with the annular piston due to the flattening of the piston in the rolling area, according to the invention the drive rolls may be mounted at different radii with respect to the center of the rotating body and/or the roll diameters may be correspondingly different. To avoid an unbalance, the drive rolls may further have different wall thicknesses. It should be understood that the increase in eccentricity designated a deformation also serves the equalization of thermally caused out-of-roundnesses. The abovedescribed form of embodiment is especially suitable for relatively high pressure ranges.

In this form of embodiment, depending on the relative position of the annular piston with respect to the parting slide, the piston may be bent between the individual drive rolls of the annular body. Furthermore, in the upper dead center position, wherein the annular piston is in contact in the area of the parting slit, the may lift off from the diametrically opposed drive roll, whereby additional stress is applied to the other drive rolls, leading to the loss of bearings and a reduction of efficiency. Also, the relatively high rpm of the drive rolls, depending on the difference in diameters between the annular piston and the drive rolls, may limit the drive rpm. In view of the limiting rpm for the bearings, especially roll bearings, of the drive rolls, a limit must be observed. Thus, for example, with a driving velocity of 3000 rpm, the difference may be 9000 rpm. High rotating velocities reduce the permissible load, shorten the useful life and the correspondingly higher bearing temperatures result in a loss of efficiency. In addition, mention should be made of the relatively high restoring forces of the annular piston which act additionally to the compressive forces on the bearings, so that overall a high load on the bearings must be expected. The deflection of the annular piston taking place between the individual drive rolls could be reduced by increasing the wall thickness of the annular piston, which however would involve an appreciable increase in the stress distribution. The apparent surface pressure in the rolling zone of the housing would be increased and high strength materials would be required. Finally, the high frequency elastic vibration in the area of the continuous parting slit as the result of the impacts of the annular piston on the cylinder should be mentioned, whereby in actual practice rapid fatigue in the vicinity of the parting slit could occur.

The abovelisted difficulties are avoided in the following forms of embodiment, which are essential for the invention. Thus, according to one of these forms of embodiment the annular piston is supported on a bearing ring or the like, which in the rolling range has a reduced wall thickness and is designed preferably as a support of uniform strength. In a further form of embodiment the annular piston is mounted floatingly on two eccentrically supported drive rolls or the like, wherein the eccentrics are arranged offset in the peripheral direction by a given angle. Finally, in an essential form of embodiment the annular piston may be mounted on spring elastic elements arranged by means of a bearing, rotatingly with respect to the eccentric. The essential feature of all of these forms of embodiment is that in the rolling range a uniform stress distribution is obtained and that peak stresses between the annular piston and the wall of the cylinder are extensively reduced and avoided. Impacts and impact like loads, especially when rolling over the parting slit are reduced so that material suitable for lesser stresses may be used in the cylinder. Inexpensive materials, especially those with a good thermal conductivity, in particular aluminum alloys, may be employed for the cylinder and the cylinder housing. This is highly important in view of the conduction of heat both from the internal space of the annular piston and the housing. By means of suitable ventilation measured, such as ventilation slits or the like, both in the housing and inside the annular piston, heat may be removed under optimum conditions. Further advantages and characteristics essential for the invention will become apparent from the examples of embodiment.

Figure 2:
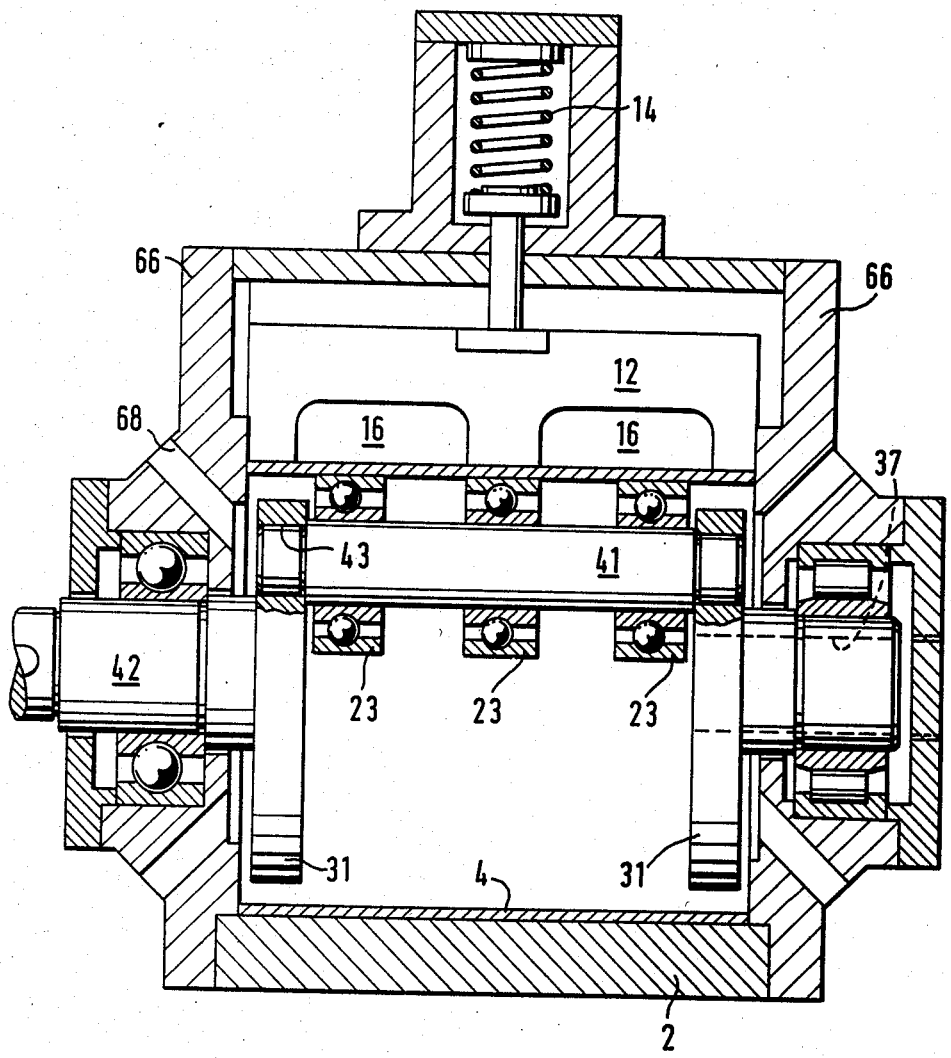
Figure 3:
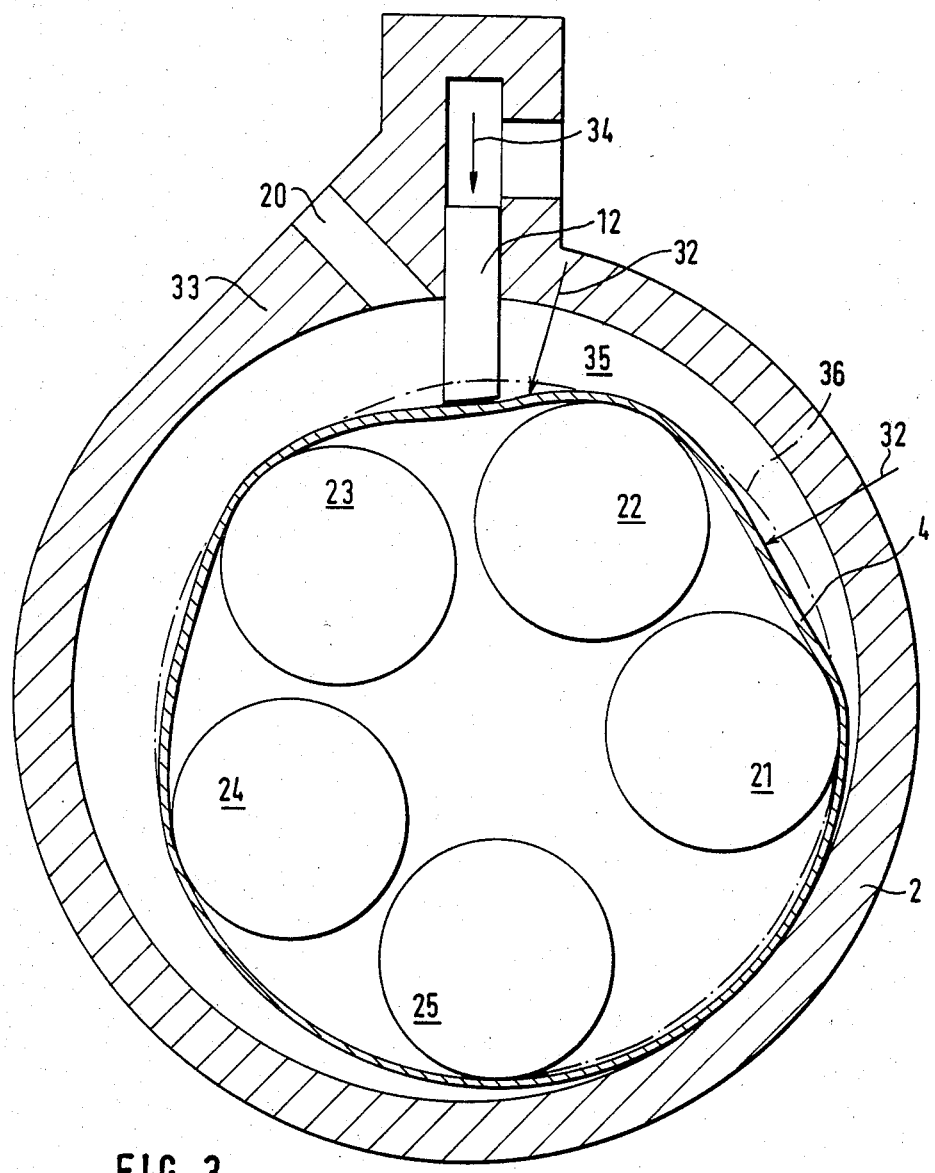
Figure 4:
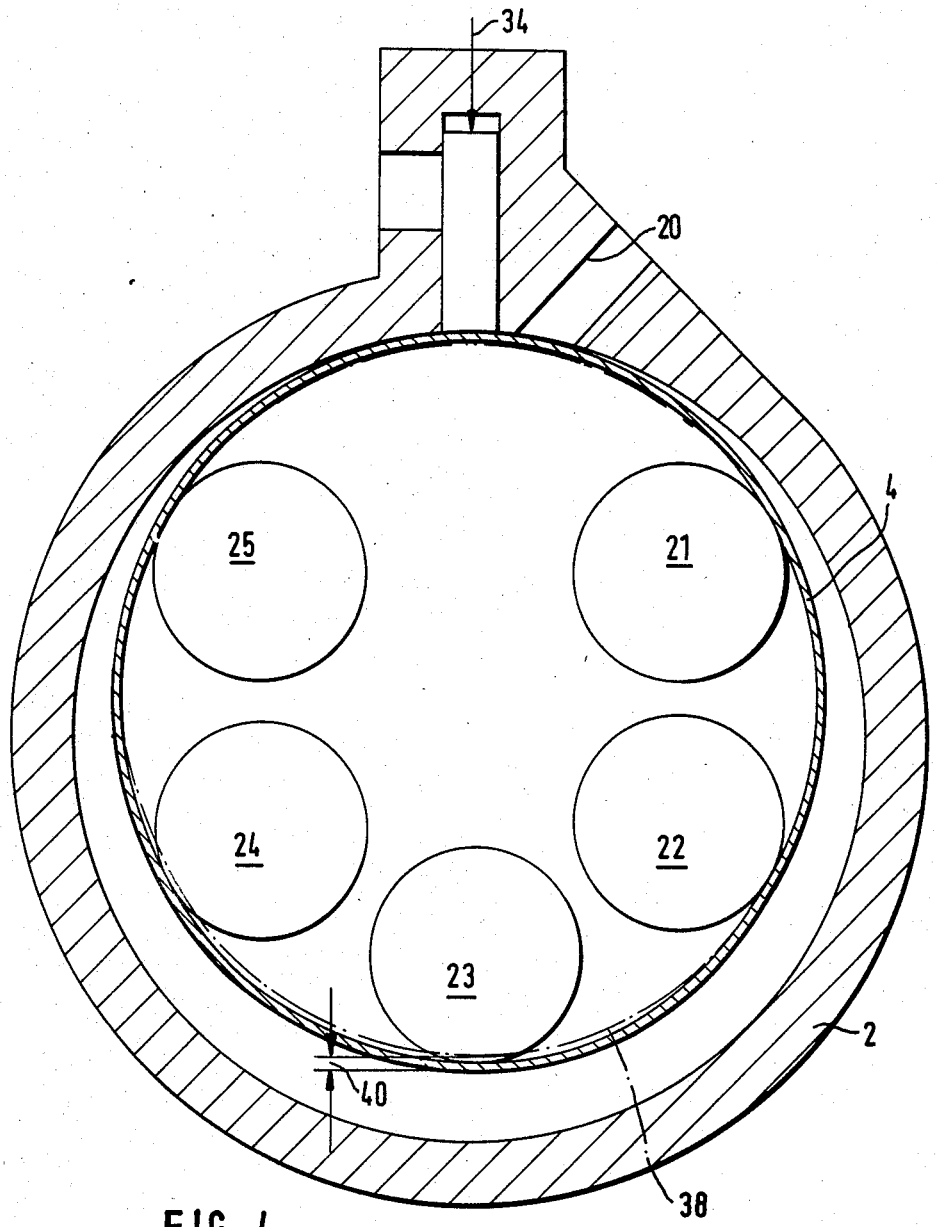
Figure 5:
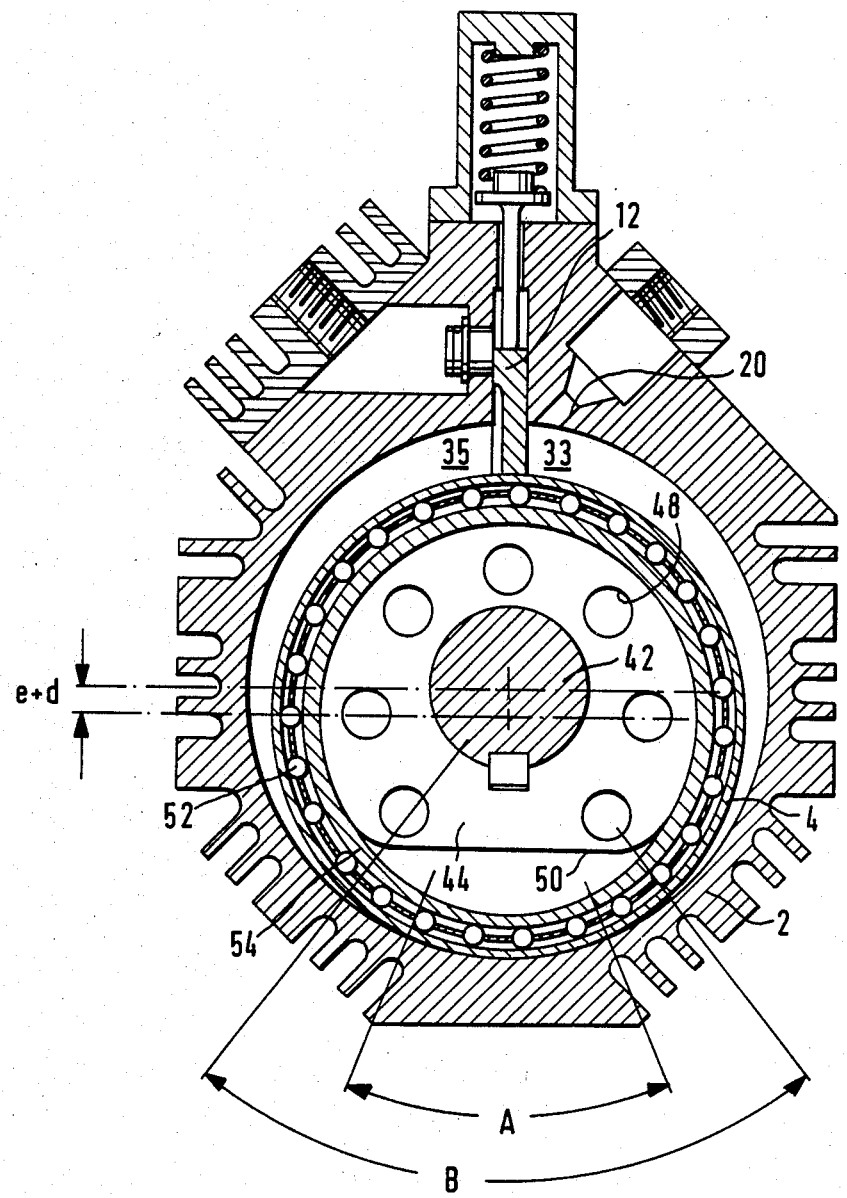
Figure 6:
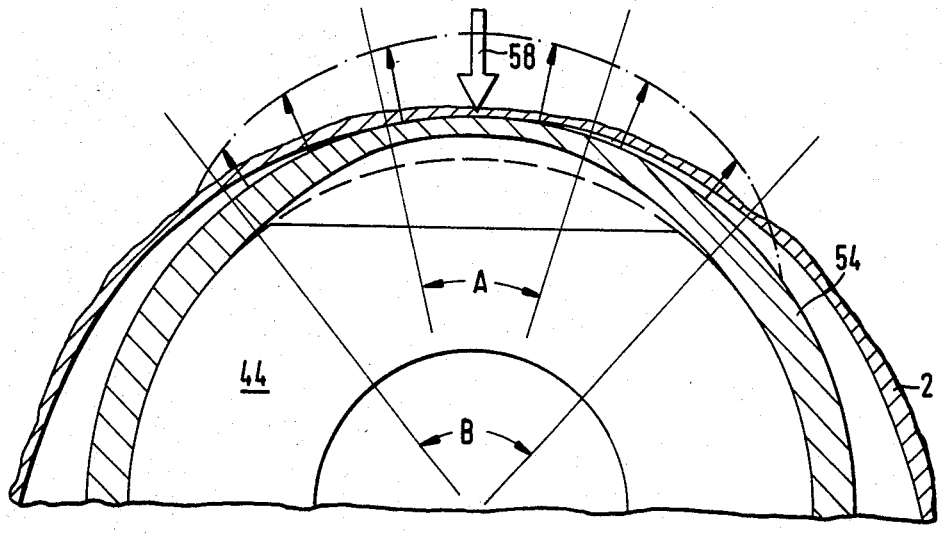
Figure 7:
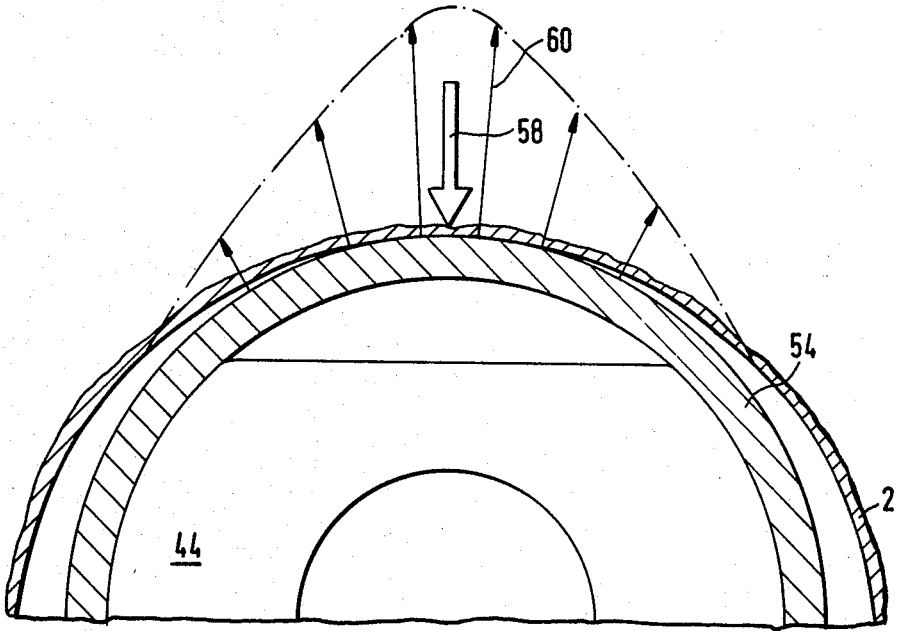
Figure 8:
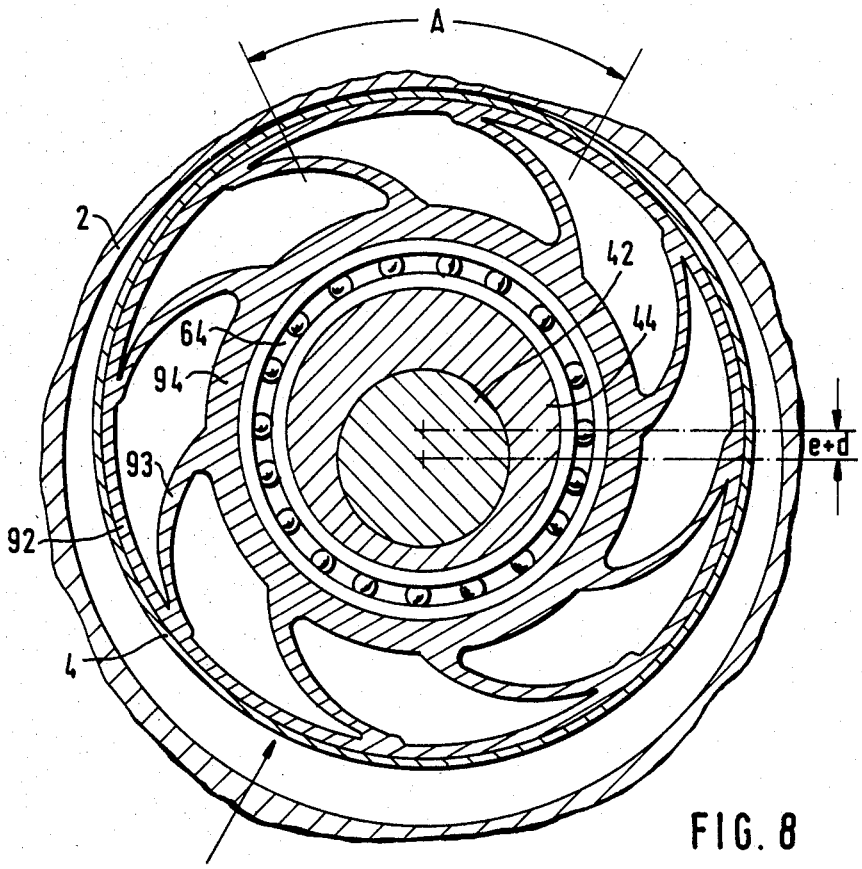
Figure 9:
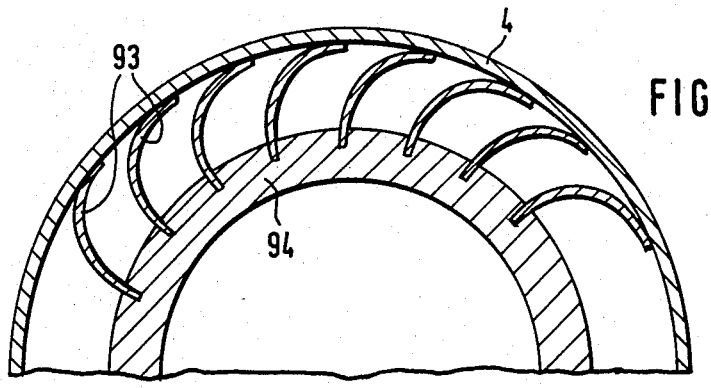
Figure 10:
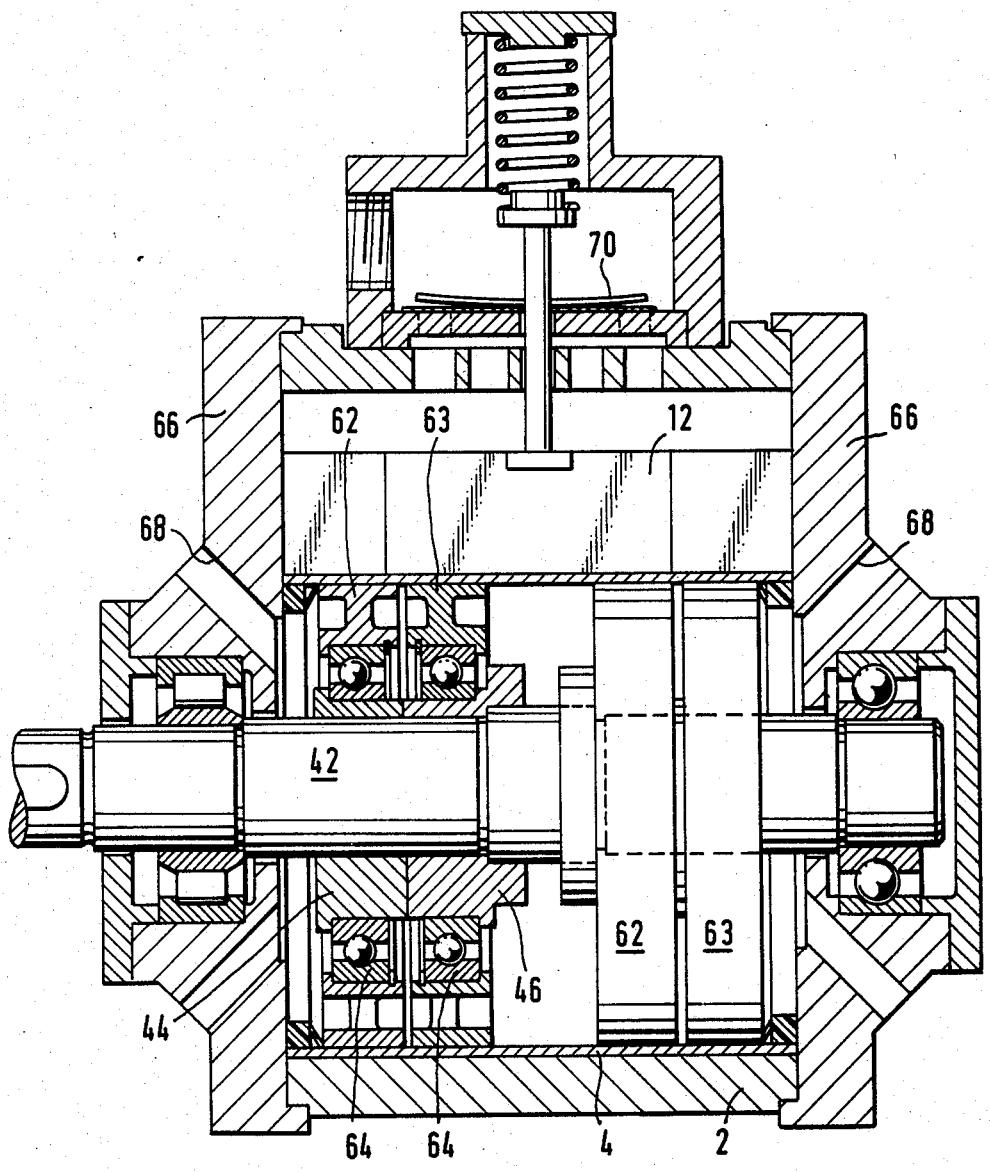
Figure 11:
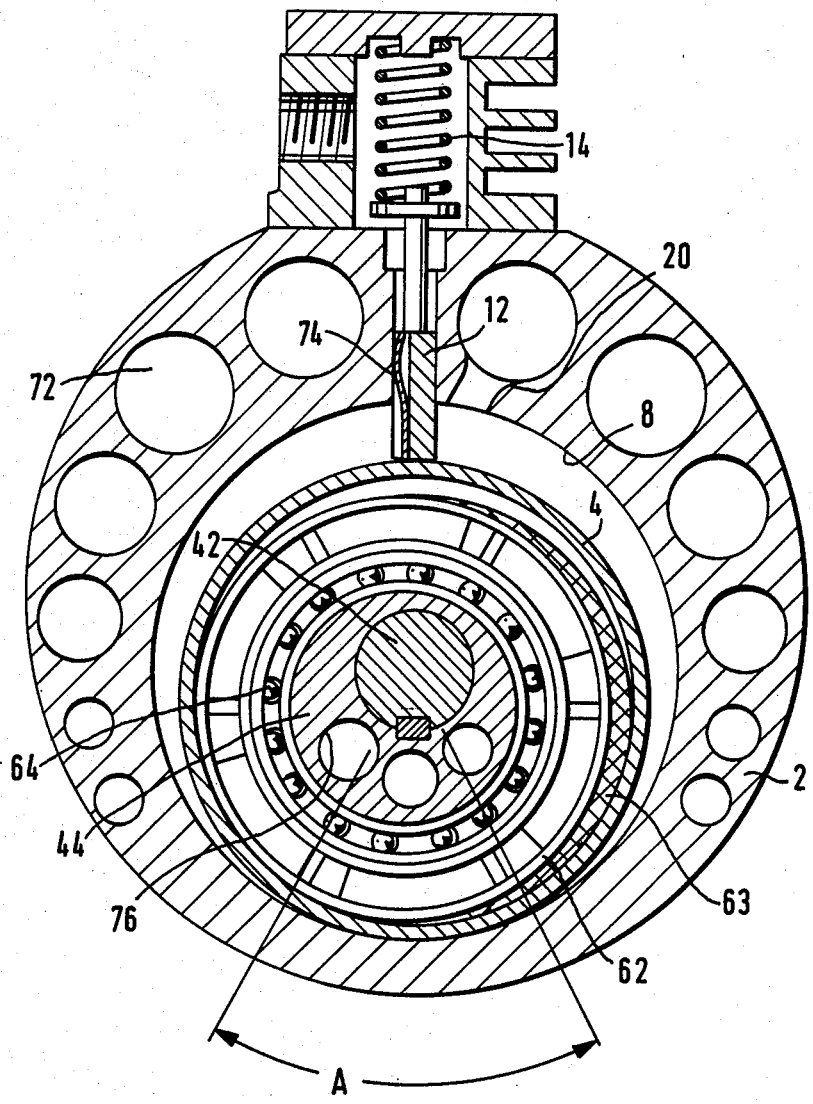
Figure 15:
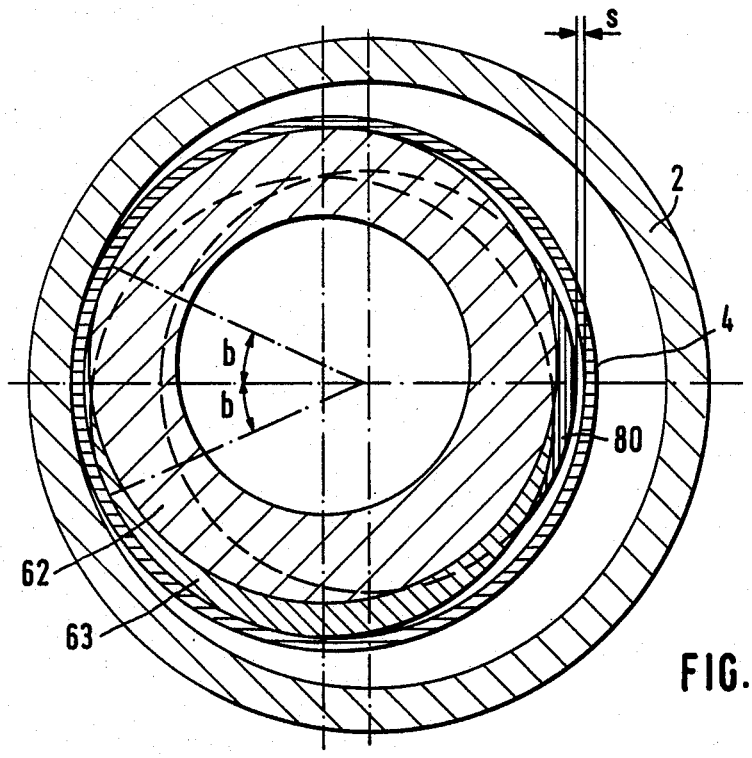
Figure 16:
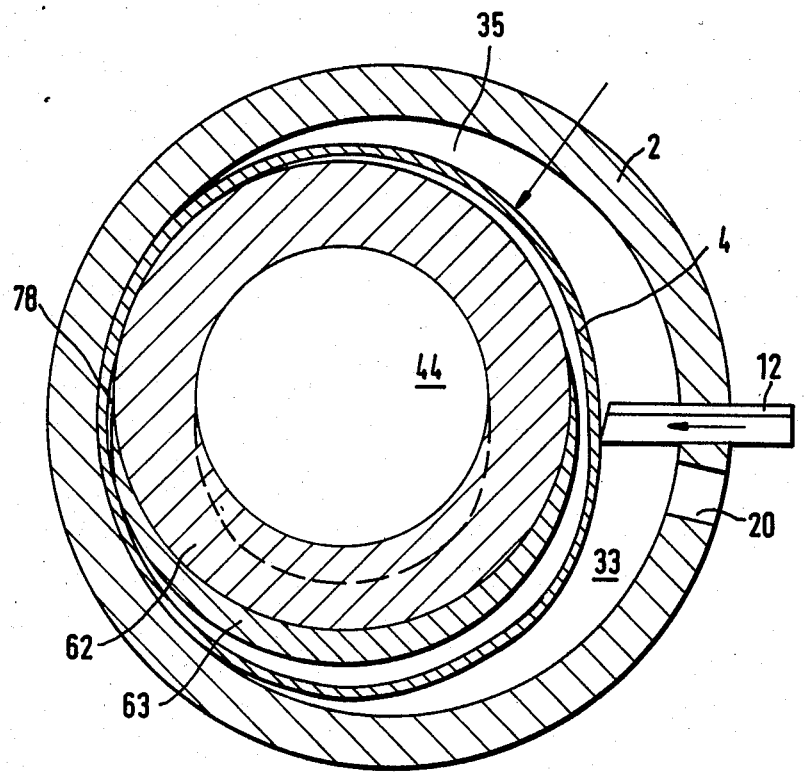
Figure 17:
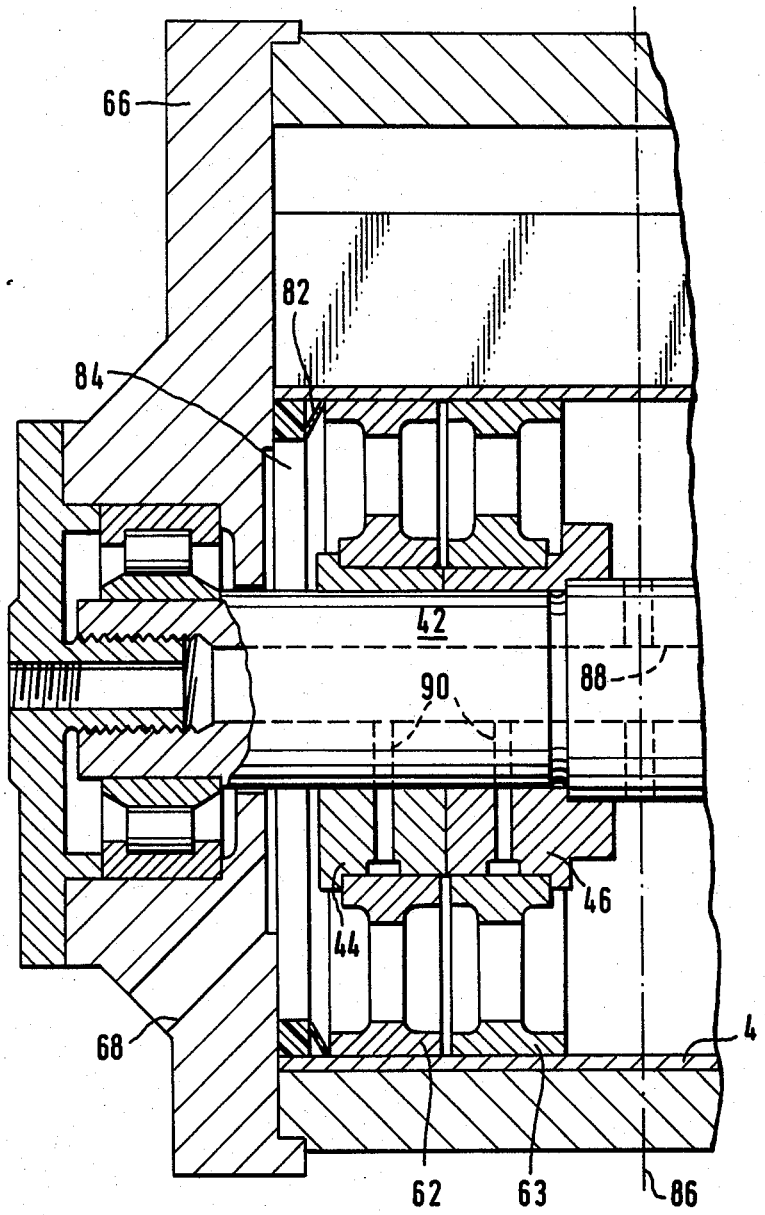
Figure 18:
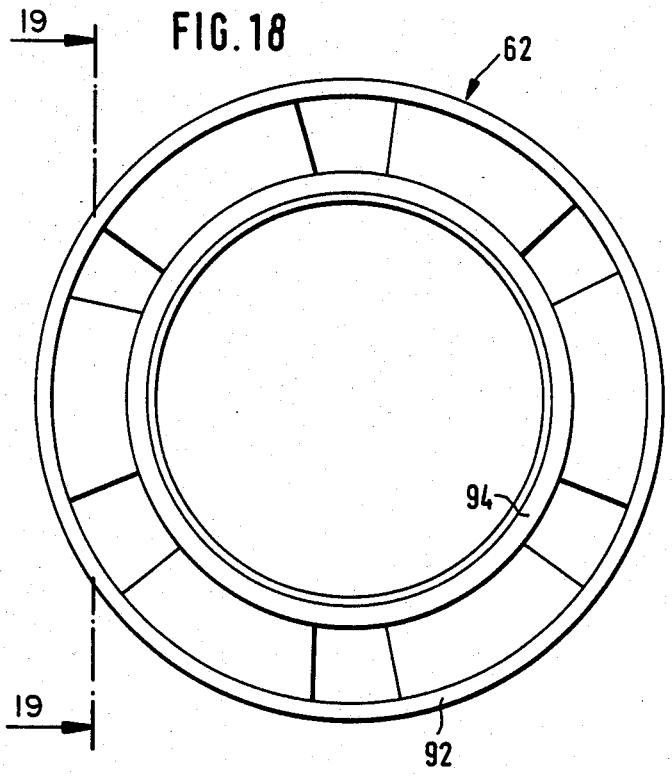
Figure 19:
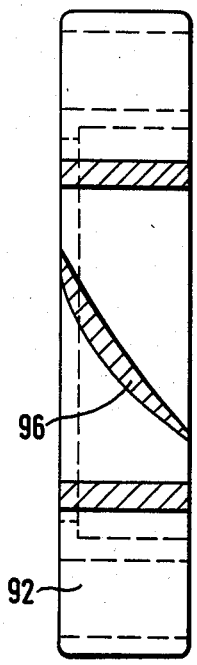
Figure 20:
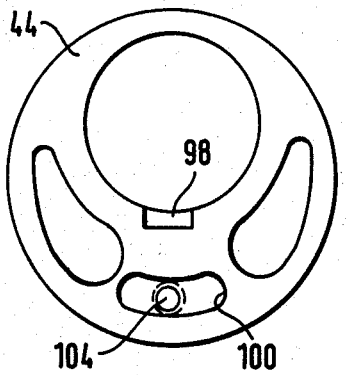
Figure 21:
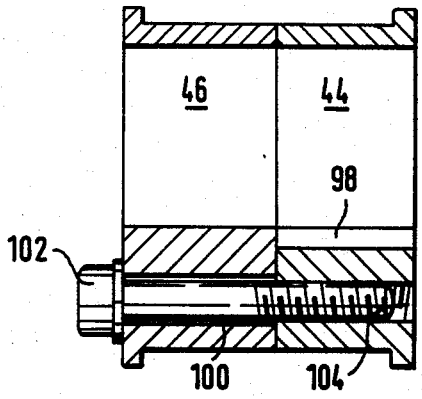
Figure 22:
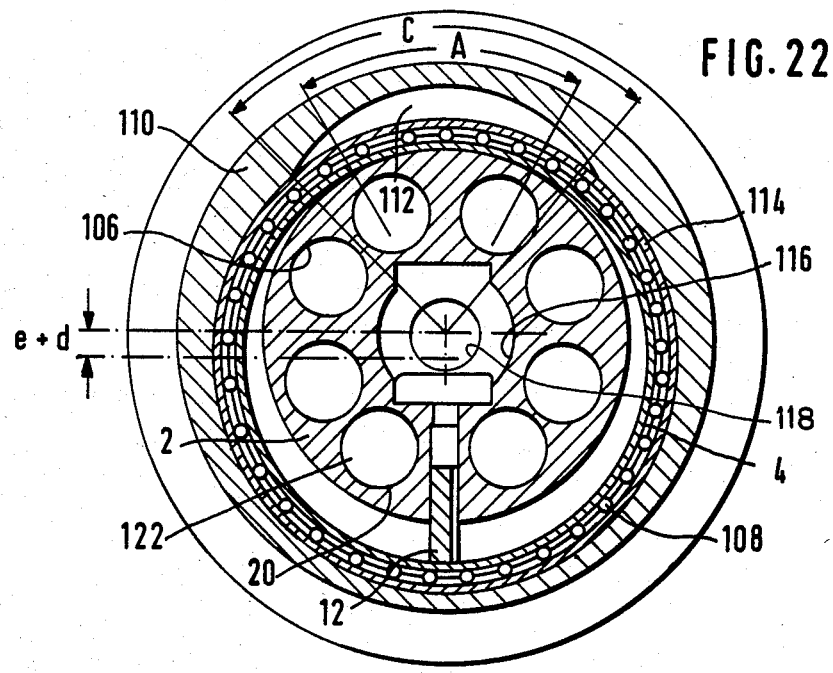
Figure 23:
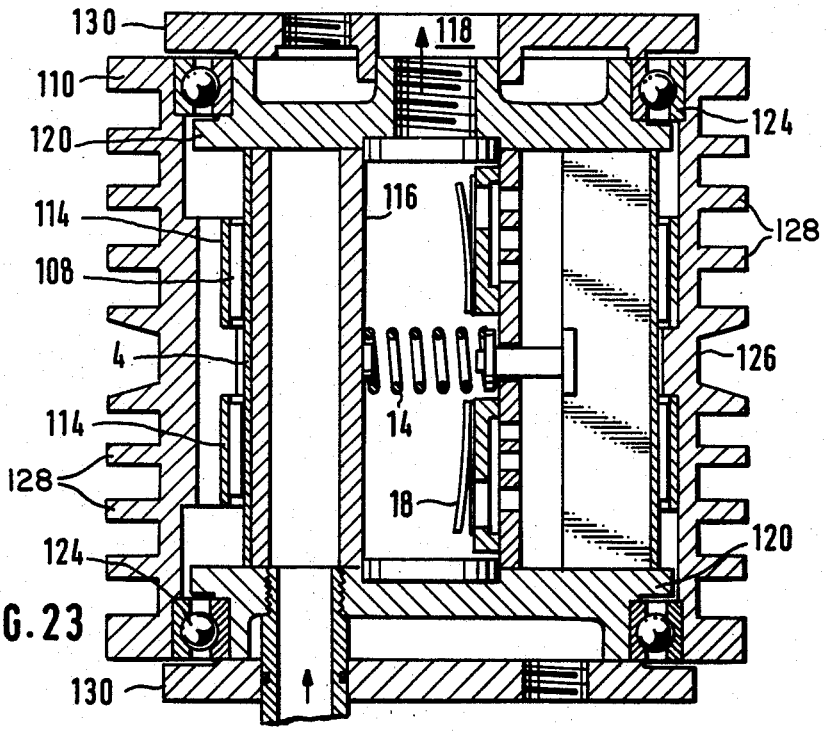
Figure 24:
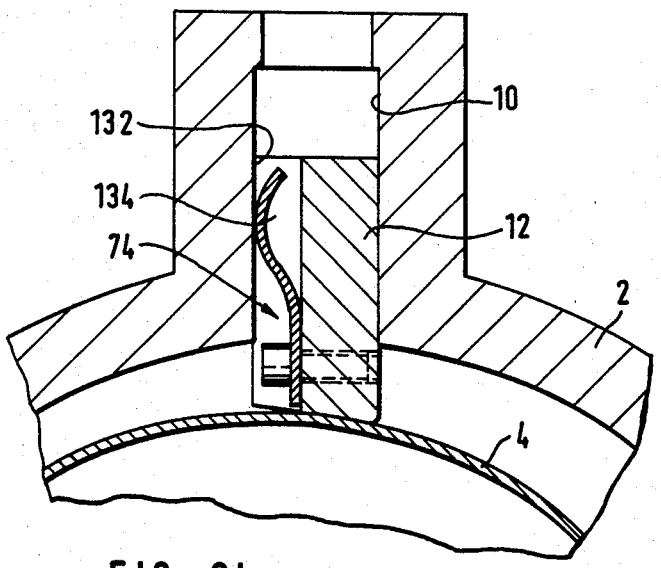
Figure 25:
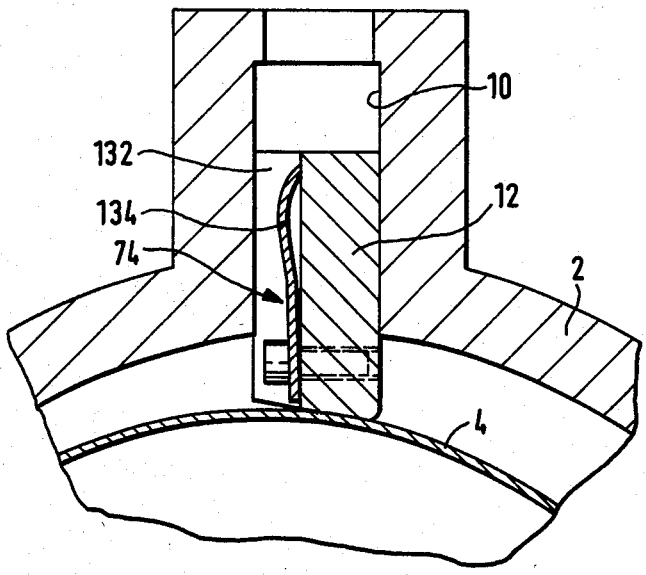
Figure 26:
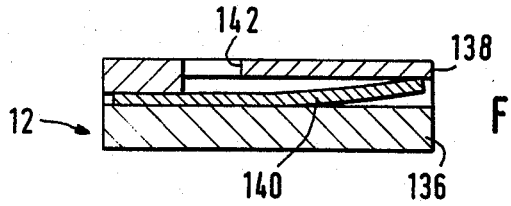
Figure 27:
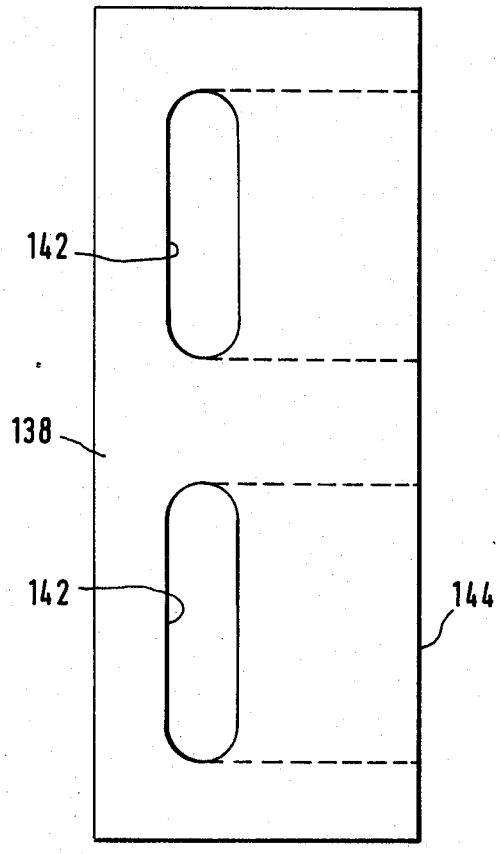
Figure 28:
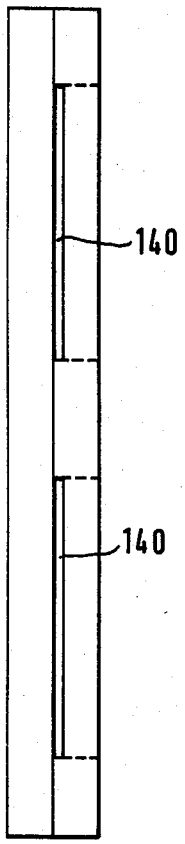

The invention shall be explained by means of the examples of embodiment shown in the drawing in more detail. In the drawing:

FIG. 1 shows a machine designed as a compressor, the annular piston whereof is supported by five drive rolls of a rotating body, FIG. 2 a longitudinal section through the machine of FIG. 1, FIGS. 3, 4 the deflection and the lifting of the annular piston in the form of embodiment according to FIG. 1, FIG. 5 a fundamental longitudinal section through a form of embodiment of the machine, wherein the annular piston is arranged in the rolling range on a bearing ring with a reduced cross section, FIG. 6 an enlarged view of the annular piston according to FIG. 5, FIG. 7 an enlarged view of an annular piston similar to FIG. 1, FIGS. 8, 9 a form of embodiment of the machine, wherein the annular piston is supported on spring elastic elements, FIG. 10 a longitudinal section through a form of embodiment of a work machine with a floating annular piston, FIG. 11 a cross section of the machine according to FIG. 10, FIGS. 12–16 schematic cross sections to explain the kinematic principle of the work machine according to FIGS. 10 and 11, FIG. 17 a form of embodiment with a floating annular piston and oil flooded slide bearings, FIGS. 18, 19 a view and a section, respectively, of a drive roll, FIGS. 20, 21 a view and a cross section, respectively, of the double eccentric to produce the rolling motion, FIG. 22 a form of embodiment according to the principle according to FIG. 5, but with an outside annular piston, FIG. 23 a longitudinal section through a work machine according to FIG. 21, FIGS. 24, 25 enlarged, a parting slide of the form of embodiment according to FIG. 4 with an integral pressure valve in the open and the closed state, respectively, FIGS. 26–28 views of a parting slide with an inside, integrated pressure valve.

FIG. 1 shows schematically a cross section of a compressor with a housing in the form of a cylinder 2, in which an annular piston is arranged rotatingly. The annular piston 4 is in contact over a predetermined rolling range A with the inner wall 8 of the cylinder 2, which on the outside is provided with cooling ribs. The cylinder 2 has a continuing parting slit 10 extending in the longitudinal direction, in which a parting slide 12 is arranged. The parting slide 12 follows the annular piston 4 by means of a compression spring 14. The parting slide 12 is shown in its working position of the "lower dead center" in keeping with a compression ratio of 1:2. In the parting slide 12 a pressure slit 16 is present, with a pressure valve 18 being associated in the cylinder with said pressure slit. A suction slit 20 may be seen further in the cylinder 2. The annular piston 4 has a constant wall thickness over its entire circumference and is supported on the inside on five rolls 21 to 25. The rolls 21 and 25 are spaced apart in a manner such that the annular piston is in a flat contact over the center rolling range A with the inner wall 8 of the cylinder 2. The center 26 of the annular piston 4 is arranged at a distance 30 from the center of the circular cylinder wall 8, said distance 30 corresponding to the natural eccentricity e due to one-half of the difference in diameter of the cylinder wall and the piston, with a deformation d added. The lastmentioned deformation or increase of the normal eccentricity e by d yields the flat contact desired in the rolling range A. According to the invention, the center 26 is rotating along a circular path K around a center 28. By means of the appropriate dimensioning of the distance of the rolls 21 and 25, the wall thickness of the annular piston 4 and the deformation d, adaptation to operational requirements is attained.

The rolls 21, 25 closest to the rolling range A are spaced apart by a substantially greater distance than the remaining rolls 21 to 25 from each other. By the dimensioning of the mutual distance of the rolls 21, 25, according to the invention the rolling range can also be affected. The drive rolls may be distributed over the rotating body in an asymmetrical manner. Within the scope of the invention, the said drive rolls may be arranged on different radii or may have different roll diameters, in order to obtain a reliable support of the annular piston even in the case of large deformations. In the compressor according to the invention, in view of an economical suction volume the diameter of the annular piston is smaller by about 5% than that of the cylinder.

FIG. 2 shows a longitudinal section of the compressor according to FIG. 1. Two flanged shafts 31 are connected with a drive shaft 42, said flange shafts being connected in turn with each other by connecting bolts 41. The connecting bolts are carrying by means of roller bearings three axially spaced apart drive rolls 23, on which the annular piston 4 is supported. The flanged shaft 31 to the right in the drawing comprises a center bore 37, through which cooling air may be blown in. The cooling air exits through the bores 68 in the housing cover 66. According to the invention there is internal cooling and heat accumulation inside the compressor is avoided. The cylinder and the annular piston are at the same approximate temperature so that longitudinal changes are kept within narrow limits. Consequently, the axial sealing gap between the annular piston and the cover 66 of the housing according to the invention may be maintained very narrow. By means of an appropriate arrangement of the eccentrically applied bores 43 for the connecting bolts 41 of all of the drive rolls, eccentricity and the deformation are assured in a structurally simple manner.

FIG. 3 shows schematically the compressor according to FIG. 1, but rotated by 180° around the longitudinal axis, with a compression ratio of approx. 1:7. The resulting gas forces 32 and the spring force 34 of the parting slide 12 deform the annular piston 4 between the drive rolls according to the dash-and-dot line 36, whereby in the unstressed suction zone initially additional radial forces are applied to the drive rolls. Particularly in the area of the rolls 23, 24, 25 the annular piston is stressed additionally by appreciable bending forces.

FIG. 4 shows schematically the compressor according to FIG. 1 in the course of the rolling of the annular piston over the pressure slit 16 and the suction slit 20. Under the effect of the gas forces and the spring force 34 of the parting slide 12, the annular piston tends to separate from the dimatrically opposite roll 23. The resulting deformation of the annular piston 4 is indicated by the broken line 38, whereby a distance 40 is observed to the roll 23.

FIG. 5 shows an essential form of embodiment of the invention, wherein structural parts coinciding in their mode of functioning with the abovedescribed form of embodiment carry the same reference symbols and are not explained further. On a drive shaft 42, two axially spaced apart drive eccentrics 44 are arranged as pressure bodies, only one is shown, said bodies being flattened in the angular area B for the mass equalization. Longitudinal bores 48 in the drive eccentrics 44 provide, together with the flattened area 50, good access of cooling air into the internal space of the annular piston 4. The annular piston 4 is capable of rotating on a needle bearing 52 with an inner bearing ring 54 on the associated eccentric. The essential feature is the reduction in wall thickness of the bearing ring 54 in the annular area B, the flattening 50 respectively, so that an extensively uniform surface pressure is present in the rolling area. The variation of the wall thickness may be calculated exactly and adjusted in combination with the prestress or deformation d selected so that in case of an unacceptably high conveying pressure the annular piston 4 lifts off in the rolling range A, thereby providing reliable protection against excessive loading. The annular piston 4 is supported over its entire periphery by means of the individual rolls of the needle bearing 52. The slight deformation d of the needle bearing according to the invention is within 0.2 to 0.7% of the bearing diameter and leaves the kinematic behavior of the needle bearing practically unaffected. In view of the deformation, an effective axial sealing of the bearing 52 is not feasible in actual practice, so that a grease or drop lubrication is indicated in this form of embodiment. The machine proposed may be produced cost effectively and is suitable both for vacuum and high pressure ranges. A compressor made in this manner has a transport capacity of for example 810 l/min with a working cylinder volume of 0.27 l and a rotating velocity of 3 000 rpm; the internal diameter of the cylinder is 125 mm and the external diameter of the annular piston 113.4 mm.

In a schematic view according to FIG. 6, radially inside the drive eccentric 44 with an inner bearing ring 54 may be seen. For the sake of simplicity, the needle bearing and the annular piston are not shown. By the aforementioned displacement of the center of the eccentric and the of the annular piston by d, in the rolling range A the contact with the wall of the cylinder 2 desired is effected and a resultant contact pressure force 58 produced. By means of the reduction of the wall thickness of the bearing ring 54 in the angular area B, that may be precalculated according to the invention, a largely uniform flat contact is produced in the rolling range A. Stress peaks are avoided. In view of the low surface pressures, for the cylinder 2 therefore materials with good thermal conductivities, in particular aluminum alloys, may be used. It is essential further that no appreciable spring-back takes place in rolling over the parting slit, whereby damage in the area of the parting slit is avoided in a simple manner. The annular piston is rolling in an essentially uniform manner over the wall of the cylinder and disturbing noises are eliminated.

FIG. 7 shows a bearing ring 54 with a wall thickness that is uniform over the periphery. This corresponds to an annular piston according to the known form of embodiment of FIG. 1. Due to the deflection in the rolling area much higher stress peaks are produced compared with the special configuration of FIG. 6, These stress peaks are indicated by the arrows 60 and they cause knocking and material fatigue during the rolling over the parting slit.

FIG. 8 shows a further essential form of embodiment, the annular piston whereof is supported on yielding elements 93 in an spring elastic manner. The elements 93 are in the form of the spokes of a wheel with an outer ring 92 and an inner ring 94. The inner ring 94 is supported by a roller bearing 64. The roller bearing 64 is not being deformed in this form of embodiment and may therefore according to the invention be completely sealed. The outer ring 92 also has a relatively thin wall, so that the annular body 4 is in flat contact in the rolling range A with the inner wall, hereby an adequately uniform force distribution is provided. The wheel is conveniently made of a single piece, which is an advantage in manufacturing and installation.

The form of embodiment of FIG. 9 in principle corresponds to that of FIG. 8, with the difference that here individual elements 93 in the form of bent flat springs are provided for the support of the annular piston 4. Here again, the inner ring 94 is not deformed so that conventional, sealed roller bearings or the like, may be used.

FIG. 10 shows a longitudinal section through a form of embodiment with a floating annular piston 4. On the drive shaft 42, drive rolls 62, 63 are arranged spaced apart in pairs, the rolling motion whereof is produced by the eccentrics 44, 45 mounted on the drive shafts 42. The transmission of force to the associated drive roll 62 is effected by means of commercially available roller bearings 64. According to the invention, these roller bearings are not deformed and may further be sealed laterally, which is of advantage specifically in vacuum applications. The drive shaft 42 is supported laterally in a housing cover 66, whereby cooling air may be blown in through bores 68. This internal cooling prevents the accumulation of heat inside the compressor, together with all of the disadvantages associated with it. Conventional tongue valves 70 are located above the parting slide 12, through which the compressed medium is ejected.

FIG. 11 shows a cross section of the machine according to FIG. 10. The cylinder housing 2 comprises a plurality of longitudinal conduits 72 for cooling media, for example air or water. In the parting slide 12 an integrated valve 74 is provided, which shall be further explained below in connection with FIGS. 24, 25. By means of the integrated tongue valve according to the invention, throttling and deflection losses are avoided. Within the annular piston 4, a drive roll 62 may be seen completely in an axial view. Behind it in the axial direction, i.e. behind the plane of the drawing, the second drive roll 63 is located; of this only a small, sickle shaped area may be seen, which for emphasis is indicated by crossed lines. As explained hereinbelow, the annular piston is being pressured in the angular rolling range A flat against the wall 8 of the cylinder 2 by means of the laterally offset arrangement of the drive roll 62 according to the invention. For internal cooling, the eccentric 44 comprises a plurality of longitudinal conduits 76.

Figure 12:
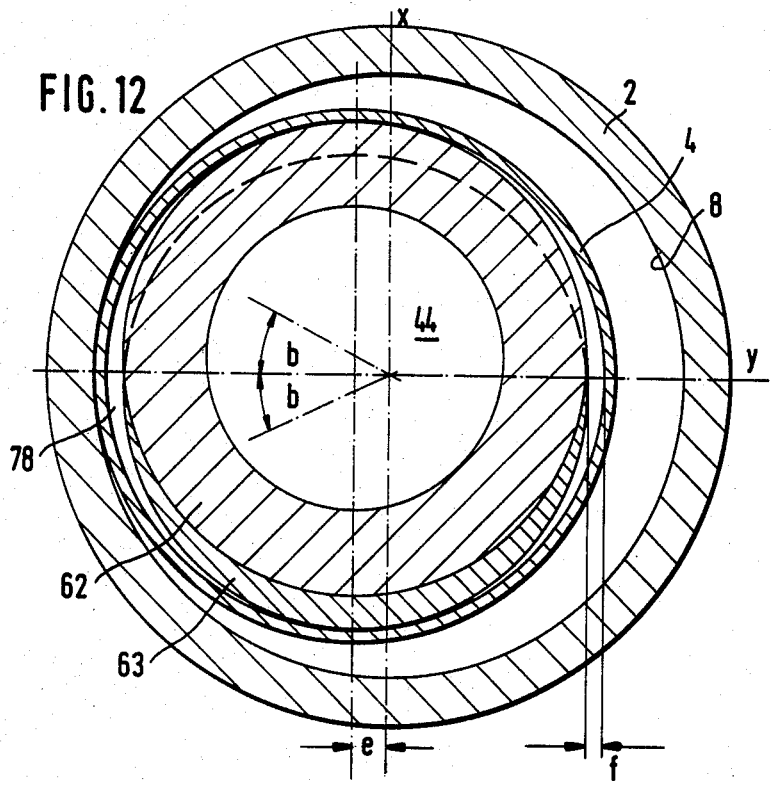

FIG. 12 shows schematically the annular piston 4 in the unstressed state, wherein the cylindrical inner wall 8 of the cylinder housing 2 is being contacted on a line in the area of the Y axis, to the left in the figure. The eccentricity e corresponds to one-half of the difference of the internal diameter of the cylinder 2 and the outer diameter of the annular piston 4. In the annular piston 4 the two drive rolls 62 and 63, which have a predetermined smaller diameter than the internal bore of the annular piston 4, are arranged in a manner such that contact with the internal bore of the annular piston 4 is given in the area of the X axis. According to the invention, the two eccentrics 44 are pivoted against each other by an angle b with respect to the Y axis. The external diameter of the drive rolls 62, 63 are in keeping with the invention smaller by at least 0.5% than the inner diameter of the annular piston 4. Between the annular piston 4 and the drive rolls therefore a spring range f is present. As the result of the pivoting of the drive rolls 62, 63 according to the invention and shown in the figure, by an angle b, a free space 78 is created in the area of the Y axis, whereby thermally generated out-of-roundnesses may be equalized. Within the scope of the invention, the pivoting may be effected by that the annular piston is given a predeformation. The radii of curvature of the cylinder and the annular pistons are thereby made to approach each other, which provides favorable conditions with respect to the surface pressure. The external diameters of the drive rolls 62, 63 are smaller by 5 to 0.8%, preferably 0.5%, smaller than the internal diameter of the annular piston 4, whereby an adequate spring range is assured. According to the invention, at least one pair of drive rolls 62, 63 is required. In keeping with the necessary axial length of the annular piston several pairs of drive rolls of this type may be mounted axially on the drive shaft in a uniformly spaced apart manner.

Figure 13:
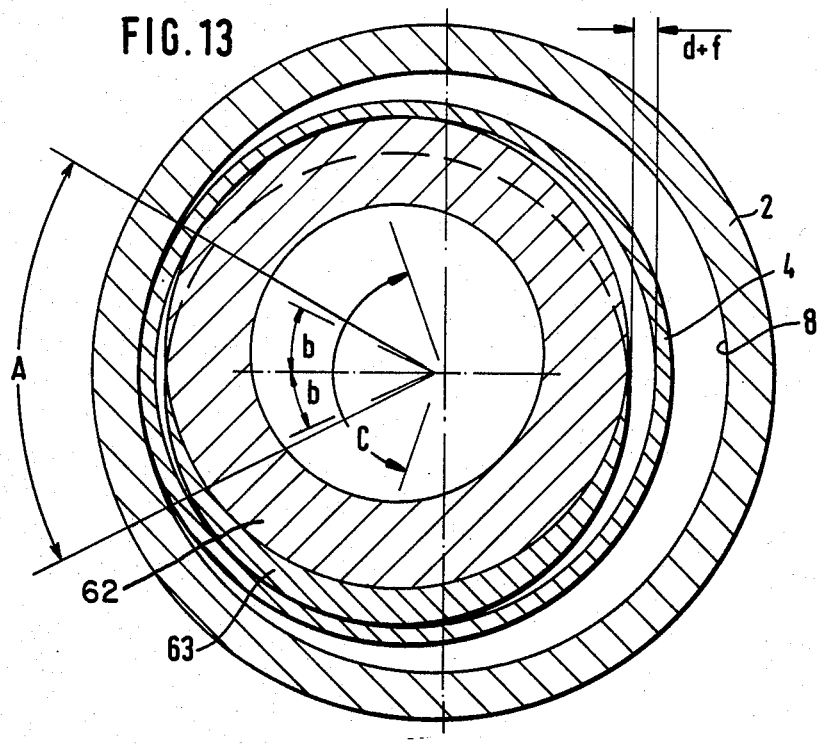

FIG. 13 shows the enlargement of the natural eccentricity e by an amount of d in the direction of the Y axis to the left. According to the invention, the annular piston 4 is contacting the wall 8 of the cylinder housing 2 elastically within the rolling range A and surrounds within an enlarged angular area C the drive rolls 62, 63. On the other side of the Y axis, the annular piston 4 lifts off by an amount of d+f from the drive rolls 62, 63.

Figure 14:
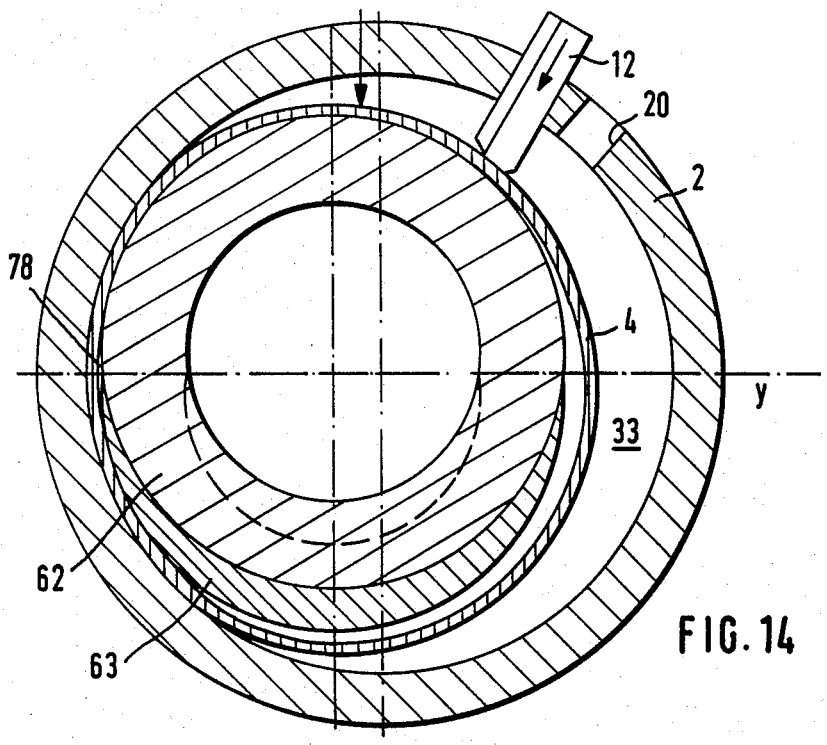

FIG. 14 shows the bearings of the floating annular piston 4 in case of a compression ratio of approx. 1:7. The resulting has forces and the forces produced by the spring and the pressure increase the contact of the annular piston 4 with the drive rolls 62, while the annular piston 4 in the virtually unstressed suction chamber 33 lifts off to a greater extent from the drive rolls 62, 63. According to the invention, this does not reduce the elastic prestressing in the rolling range. In the area of the Y axis the free space 78 reduced by the prestressing may be seen; it makes it possible for the drive rolls 62, 63 to equalize any out-of-roundness caused by the temperature.

FIG. 15 essentially corresponds to FIG. 13, with in addition to the drive rolls 62, 63 a roll 80 being arranged inside the annular piston 4 on the drive shaft, between the two axially spaced apart pairs of drive rolls 62, 63. This roll 80 projects on the Y axis, diametrically opposite the rolling range, past the drive rolls 62, 63 and only the free path s exists. The deflection of the annular piston 4 is restricted to the free path. In the case of high pressures a secure support of the annular piston 4 is obtained.

FIG. 16 shows the position of the annular piston 4 at a compression ratio of approx. 1:2. The contact with the drive rolls 62, 63 is here slightly weaker than according to FIG. 11. It may be seen, however, in both figures that the resultant gas and slide forces increase the surface pressure in the rolling range and that the annular piston 4 is lifted off in the unstressed suction zone 33 from the drive rolls with increasing degrees of compression. In this manner it is obtained according to the invention that within the rolling range a largely constant surface pressure is generated. Due to the contact according to the invention of the annular piston 4 with the drive rolls 62, 63, there is no additional stress on the annular piston 4 even under the highest compressive stress. In keeping with the invention, the maximum deformation forces and the stress distribution are determined by the difference in diameter of the drive rolls 62, 63 and the inner diameter of the piston 4. In particular, this slight difference in diameters amounts to between 0.8 and 3%, whereby slight relative movements are attained between the drive rolls and the annular piston. The corresponding low stressing of the annular piston 4 permits the use of cost effective materials. The exact precalculation of the elastic contact pressure force is made possible according to the invention by the corresponding predetermination of the wall thickness of the annular piston 4 and the aforementioned difference in diameters.

FIG. 17 shows in part a longitudinal section of a form of embodiment of the machine with a floating annular piston 4. The drive rolls 62, 63 are here supported by means of slide bearings directly on the two driving eccentrics 44. The annular piston 4 is sealed off laterally by means of elastic sealing elements 84 under the pressure of springs 82, at the housing cover 66. The machine according to the invention with oil flooded slide bearings is laid out correspondingly to the right of the center line, wherein there the drive shaft 42 may also be driven. Through the hollow drive shaft 42 according to the invention in this form of embodiment oil is introduced through an axial bore 88 and conducted through the radial bores 90 to said radial bearings of the drive rolls 62, 63 for lubrication. The oil passes between the drive rolls 62, 63 inside the annular piston 4 and may be let out from there through the bores 68 of the housing cover 66.

FIG. 18 shows the drive roll 62, while in FIG. 19 a section along the line 19—19 of FIG. 18 is represented. As seen in FIG. 19, curved baffles 96 are placed between the outer ring 92 and the inner ring 94, through which air may be suctioned into the inner space of the annular piston.

FIGS. 20 and 21 show in a view and in an axial section the drive eccentric 44, 46. The drive eccentric 44 comprises a feather key groove 98 for its fastening to the drive shaft. The drive eccentric 46 comprises a longitudinal groove 100, through which a screw 102 is passing to engage a thread 104 of the eccentric 44. The two eccentrics 44, 46 may thus be rotated with respect to each other for tolerance compensation and to adjust the aforementioned prestress, wherein their mutual stressing and immobilization is effected by means of the screw 102.

FIGS. 22 and 23 show in cross section and a longitudinal section a form of embodiment of the machine corresponding in its kinematic principle to that of FIG. 5, wherein however the annular piston 4 is arranged radially outside with respect to the housing 2. This form of embodiment is especially suitable for a belt drive or direct flanging onto an electric drive motor. The housing 2 comprises cooling bores 106 and the annular piston 4 is supported directly by means of a needle bearing 108 in a drive ring 110. The drive ring 110 is here again offset by an amount e+d with respect to the housing 2, so that the annular piston 4 is in contact with the outer surface of the circular housing 2 in the rolling range A. The drive ring 110 comprises over an angular distance C a recess 112 and here the outer bearing ring 114 has a reduced wall thickness. In this manner the same kinematic and stress conditions as in the form of FIG. 5 are achieved. The parting slide 12 is being guided in the housing 2 and is mobile toward the center. The spring 14 and the pressure valves 18 are arranged in a center bore 116. The medium being conveyed under pressure is removed through the bore 118 in a cover disk 120. Suction is effected through a bore 122 adjacent to the slide 12. The drive ring 110 is supported by means of roller bearings 124 on both sides with respect to the cover disks 120. The drive ring 110 comprises an annular groove 126 for a belt drive and a plurality of cooling ribs 128, arranged for mass equalization eccentrically in relation to the bearing ring. Cooling is effected according to the invention by convection of the rapidly rotating outer ring 110, wherein hot air is suctioned off the outer surface of the annular piston 4 through center bores in the outer ring. The stationary housing 2 may be cooled additionally by air or water through the cooling bores 106. In the case of water cooling, the cover disks 120 are covered by closed plates 130. The advantage of this configuration is the compact, circular structure, the automatic cooling of the drive ring 110, the possibility of combination air and water cooling and beyond these, an appropriate mass equalization by the variation of the wall thickness of the drive ring. In this embodiment, the working fluid is introduced into longitudinal bore 122 of the housing through a connection (not shown) similar to that shown for the cooling medium at the lower left of FIG. 23. The working fluid passes from longitudinal bore 122 through vacuum slit 20 into the vacuum chamber formed between the exterior of housing 2 and the interior of annular piston 4 at the left of parting slide 12. Upon rotation of annular piston 4, the working fluid passes from the vacuum chamber into the pressure chamber at the right of parting slide 12 and thence through the radial slit in parting slide 12 and through valve 18 radially inwardly into the central bore 116 from which it flows under pressure through outlet 118.

FIGS. 24 and 25 show enlarged the parting slide with an integrated pressure valve 74 in the parting slit 10 of the cylinder housing 2 in the closed and the opened state. The parting slide 12 comprises at least one radially continuous slit 132, with conveniently a plurality of such slits 132 being provided in an axially spaced apart arrangement. The spring elastic valve plate 134 is guided laterally in the said slit 132. The valve plates 134 extend according to the invention over a predetermined great length of preferably about 80% of the length of the parting slide, so that with the valve open, a large outlet cross section is provided. By means of this essential configuration the medium, in particular gas, may flow out at a low velocity and without appreciable throttle losses. It should be noted that with conventional valves the passage area is smaller than the cover surface area of the valve plate. Thus, if a valve plate is pressured by a terminal pressure Pe against the sealing surface, a correspondingly higher pressure must be applied to the opening of the valve. If, for example, a circular passage area f 1 with a diameter d 1 is given and a circular cover surface area f 2 with a diameter d 2 is present, the opening pressure P 1 is equal to Pe multiplied by the square of d 2 divided by d 1. If, for example, the passage bore has a diameter d 1 of 14 mm and the sealing surface area a diameter d 2 of 17 mm, and the terminal pressure is 17 bar, the pressure in the cylinder must rise to 9.7 bar to raise the valve. The pressure peak generated in this manner leads to an increase in the temperature of the gas and to additional stresses on the bearings and the material. By means of the integrated plate valve according to the invention such pressure peaks are extensively avoided. As the result of the curving of the valve plate 134 essential to the invention, only a near line shaped contact is given in the parting slit 10. Furthermore, by means of this essential curvature outflow losses are reduced, and simultaneously, the stroke of the valve may be limited. The preferred form of embodiment explained with reference to FIGS. 24 and 25 is suitable especially for vacuum and low pressure operations and for oil flooding. The curved valve plate 134 sliding back and forth on the inner surface of the valve slit 10 prevents backflow in the throttle gap and is insensitive to the transport of steam and liquid containing gases and further permits the free outflow of cooling oil in an oil flooded machine.

In FIGS. 26 to 28 a form of embodiment of an integrated valve is shown which is particularly suitable for high pressures and dry running machines. The parting slide 12 consists of two parts 136, 138, between which valve plates 140 are clamped in. By means of this form of embodiment friction losses in the parting slit of the housing are reduced appreciably. The medium enters through wide slits 142 into the inner valve chambers and flows out on the upper side 144 of the parting slide. Due to the wide inlet slits 142, gas velocities are low and the deflection losses are restricted.

We claim:

1. Apparatus for compressing and conveying fluids, said apparatus comprising a cylinder, a thin-walled, radially resiliently deformable, annular, rolling piston arranged eccentrically within said cylinder in surface contact with one cylinder wall throughout a predetermined angular region of rolling contact, a parting element extending between the cylinder wall and the annular piston for dividing a suction chamber from a pressure chamber within said cylinder, and a rotating body for imparting a rotating motion to said annular piston, said annular piston being essentially circular, the center of the annular piston with the rotating body therein being disposed offset from the center of the cylinder in the direction of rolling contact between the annular piston and the cylinder a distance equal to the sum of the eccentricity (e) and a deformation (d), the eccentricity (e) being equal to one-half the difference between the diameter of said cylinder and the diameter of said annular piston, the magnitude of the region of rolling contact (A) being greater than 10° and being predetermined by the deformation (d), and said annular piston being deformed in said region of rolling contact such that the curvature of the outer surface of said annular piston in said angular region of rolling contact conforms to the curvature of said cylinder wall.

2. Apparatus according to claim 1, wherein the deformation (d) amounts to from about 0.2 to about 2% of the diameter of said annular piston, and the center of said annular piston is rotated substantially along a circular path around the center of said cylinder.

3. Apparatus according to claim 1, wherein the deviation of the annular piston from the circular form is at most 3% of its external diameter, and the wall thickness of said annular piston is less than 5% of its external diameter.

4. Apparatus according to claim 1, wherein a plurality of rotatable drive rolls are arranged in offset fashion around the periphery of the rotating body such that the drive rolls closest to the region of rolling contact are spaced a greater distance from each other than the spacing between the remaining drive rolls.

5. Apparatus according to claim 4, wherein said rotating body comprises two flanged shafts supported in housing covers, said shafts being connected with each other within said annular piston by means of connecting bolts, whereby the connecting bolts are rotatable with respect to said drive rolls.

6. Apparatus according to claim 1, wherein said annular piston is supported on a bearing ring, said bearing ring having a reduced wall thickness in the region of rolling contact between said annular piston and said cylinder wall.

7. Apparatus according to claim 6, wherein said annular piston is supported directly on a needle bearing having an inner bearing ring which is arranged on an eccentric drive member having a flattened area in the region of rolling contact.

8. Apparatus according to claim 7, wherein two axially spaced apart eccentric drive members are provided, said eccentric drive members being pivotable and adjustable with respect to each other for equalizing tolerances.

9. Apparatus according to claim 1, wherein said annular piston is arranged on elastically yielding elements which may be rotated with respect to said eccentric drive member by means of a bearing.

10. Apparatus according to claim 9, wherein said elastically yielding members comprise helical spokes extending between inner and outer rings of a wheel member, said inner ring being disposed on said bearing and said outer ring comprising a thin-walled member on which said annular piston is arranged, said inner and outer rings and helical spokes comprising a single integral piece.

11. Apparatus according to claim 9, wherein said elastically yielding elements comprise individual leaf springs secured in recesses in an inner ring of said annular piston.

12. Apparatus according to claim 1, wherein said annular piston is arranged in floating fashion on two eccentrically supported drive rolls, the eccentric portions of which are offset with respect to each other in the peripheral direction by a predetermined angle.

13. Apparatus according to claim 12, wherein said drive rolls are each supported by means of sealed bearings on eccentric drive members, said eccentric members being offset by a predetermined angle around the drive shaft.

14. Apparatus according to claim 12, wherein said drive rolls have a diameter which is less than 5% smaller than the inner diameter of said annular piston.

15. Apparatus according to claim 13, wherein at least two axially spaced apart pairs of drive rolls are arranged on said drive shaft together with said eccentric drive members.

16. Apparatus according to claim 12, wherein a limit roll is located on said drive shaft diametrically opposite the region of rolling contact between said annular piston and said cylinder wall between two pair of drive rolls to limit the deflection of said annular piston.

17. Apparatus according to claim 13, wherein the angular positions of said two eccentric drive members are adjustable with respect to each other to compensate for tolerances and wear.

18. Apparatus according to claim 12, wherein said drive rolls are provided with fan blades for automatically ventilating inner spaces within said drive rolls.

19. Apparatus according to claim 1, wherein said parting element comprises an integrated valve having a valve plate with arcuate sealing surfaces located in a recess in said cylinder wall.

20. Apparatus according to claim 1, wherein said parting element comprises an integrated valve with a plurality of valve plates arranged adjacent each other in the longitudinal direction of said parting element, and wherein the valve plates are located in recesses which extend over up to 80% of the length of said parting element.

21. Apparatus for compressing and conveying fluids according to claim 1, wherein said annular piston has a deviation from circular of at most 5% of the diameter of the annular piston.

22. Apparatus according to claim 1, wherein said thin-walled, deformable, annular piston is internally supported radially by a plurality of internal rolls, and said annular piston is contacted by said internal rolls only outside an angular region which surrounds and is larger than said region of rolling contact between said annular piston and said cylinder.

23. Apparatus according to claim 1, wherein an inlet is provided in said cylinder adjacent one side of said parting element, and an outlet channel leading to a pressure valve is formed in the opposite side of said parting element.

* * * * *